US009587416B1

(12) United States Patent
Liu

(10) Patent No.: US 9,587,416 B1
(45) Date of Patent: Mar. 7, 2017

(54) LOCK WITH A SLIDE FOR COVERING LOCK CORE

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 15/220,800

(22) Filed: Jul. 27, 2016

(51) Int. Cl.
*E05B 17/18* (2006.01)
*E05B 17/14* (2006.01)
*E05B 67/02* (2006.01)

(52) U.S. Cl.
CPC ..... *E05B 17/142* (2013.01); *E05B 17/185* (2013.01); *E05B 67/02* (2013.01); *E05B 17/18* (2013.01); *Y10T 70/7955* (2015.04); *Y10T 70/8649* (2015.04)

(58) Field of Classification Search
CPC ..... E05B 17/142; E05B 17/185; E05B 67/02; E05B 17/18; E05B 17/14; Y10T 70/7955; Y10T 70/796; Y10T 70/7966; Y10T 70/7972; Y10T 70/7977; Y10T 70/7983; Y10T 70/8649
USPC ..... 70/54–56, DIG. 43, DIG. 56, 367–369, 70/371, 423–428, 455
See application file for complete search history.

(56) References Cited

U.S. PATENT DOCUMENTS 1,314,306 A * 8/1919 Cullison ..... B60K 15/04 220/816
1,369,506 A * 2/1921 Voight ..... E05B 17/183 70/455
1,517,924 A * 12/1924 Teich ..... E05B 17/185 70/455
1,741,093 A * 12/1929 Briggs ..... E05B 15/1614 411/517
1,904,882 A * 4/1933 Prior, Jr. ..... E05B 63/122 70/1.5
2,213,814 A * 9/1940 Jacobi ..... E05B 17/185 70/455
2,343,605 A * 3/1944 Wise ..... B60K 15/0409 70/455
2,355,300 A * 8/1944 Johnstone ..... E05B 17/185 70/455
2,388,228 A * 10/1945 Johnstone ..... E05B 17/185 70/455
2,400,229 A * 5/1946 Freeman ..... E05B 17/185 70/379 R (Continued)

*Primary Examiner* — Lloyd Gall
(74) *Attorney, Agent, or Firm* — Rosenberg, Klein & Lee

(57) ABSTRACT

A lock includes a housing having an insertion hole in which a pivot is inserted. A slide is connected to one end of the pivot. A spring is located in the insertion hole and applies a first resilient force toward the insertion hole, and a second resilient force toward a direction that the slide pivots. When the slide is located at a first position, the installation recess is covered by the slide to prevent water and dust from entering into the installation recess. When the slide located at a second position, at least one portion of the slide does not cover the installation recess to allow the lock to be unlocked. When the slide located at a third position, the slide is located higher than the first end face of the protrusion and is pivotable so that the installation recess is explored for convenience of replacement of the core.

13 Claims, 12 Drawing Sheets

(56) References Cited

U.S. PATENT DOCUMENTS 2,439,978 A * 4/1948 Konchan ..... E05B 17/185 220/253
2,562,038 A * 7/1951 Jacobi ..... E05B 17/185 70/455
2,602,319 A * 7/1952 Jacobi ..... E05B 17/185 70/455
2,660,877 A * 12/1953 Malouf ..... B60K 15/0409 220/DIG. 33
2,702,468 A * 2/1955 Spain ..... E05B 17/185 70/455
2,733,831 A * 2/1956 Nehls ..... B60K 15/0409 220/302
2,931,209 A * 4/1960 Dies ..... E05B 17/185 70/455
3,422,643 A * 1/1969 Foote ..... E05B 67/02 70/371
3,898,824 A * 8/1975 Borlinghaus ..... E05B 17/185 70/423
3,930,391 A * 1/1976 Borlinghaus ..... E05B 17/185 70/455
4,192,161 A * 3/1980 Borlinghaus ..... E05B 17/185 70/452
4,290,278 A * 9/1981 Porter ..... D04H 3/02 28/100
4,545,223 A * 10/1985 Poutiainen ..... E05B 67/24 70/368
4,586,355 A * 5/1986 Lee ..... E05B 17/185 70/452
4,587,817 A * 5/1986 Self ..... E05B 15/1614 70/427
4,597,274 A * 7/1986 Coscia ..... E05B 17/185 70/452
4,674,308 A * 6/1987 Peters ..... E05B 17/185 70/423
4,723,428 A * 2/1988 Yamaguchi ..... E05B 17/185 70/423
4,881,391 A * 11/1989 Villa ..... E05B 17/185 70/423
5,572,890 A * 11/1996 Carpenter ..... E05B 15/1614 70/371
5,718,137 A * 2/1998 Huston ..... B62H 5/02 70/423
6,092,404 A * 7/2000 Chhatwal ..... E05B 47/00 70/278.1
6,272,890 B1 * 8/2001 Huston ..... B60R 25/021 70/423
6,408,661 B1 * 6/2002 Chen ..... E05B 67/36 70/226
7,225,651 B2 * 6/2007 Edwards ..... E05B 9/086 70/369
7,401,484 B1 * 7/2008 Holmes ..... E05B 13/10 292/336.3
7,591,159 B2 * 9/2009 Tsuchikiri ..... B60R 25/04 70/252
7,707,863 B2 * 5/2010 Tsuchikiri ..... B60R 25/04 70/252
7,735,347 B2 * 6/2010 Tsuchikiri ..... B60R 25/04 70/423
8,474,290 B2 * 7/2013 Terhaar ..... E05B 17/04 292/21
2008/0190157 A1 * 8/2008 Mizuno ..... E05B 17/183 70/455

* cited by examiner

LOCK WITH A SLIDE FOR COVERING LOCK CORE

BACKGROUND OF THE INVENTION

1. Fields of the Invention

The present invention relates to a lock, and more particularly, to a lock with a slide which is moved to a position to cover the lock core when the lock is not in use.

2. Descriptions of Related Art

The conventional locks generally comprise a housing with a core located therein. A bead system is received in the core and includes multiple recesses and each recess receives multiple beads therein. In order to increase safety, resilient members and duplicate bead units are added in the bead system. The core has a keyhole in which a key can be inserted to arrange the beads to a unlock position so that the core can be rotated.

It is noted that the key hole is exposed and dust, moisture can easily enter the core to cause rusting to the parts in the core because most of the parts are made by metal. The rusted parts may affect rotation of the core. Besides, pebbles and sands may also enter into the core, and some parts in the core has lubricant attached thereto and the pebbles, sands and dust are easily attached to the lubricant to block the movement of the beads such that the lock is difficult to be locked or unlocked.

Furthermore, most of the locks are located outside of houses, such as paddle locks, door locks or vehicle locks, these locks can easily be affected by rain, dust, pebbles and sands and have to be replaced with a lot of money spent.

The present invention intends to provide a lock with a slide which covers the core when the lock is not in use so as to eliminate the shortcomings mentioned above.

SUMMARY OF THE INVENTION

The present invention relates to a lock and comprises a housing having an installation recess and an insertion hole defined in the underside thereof. A flat face and a protrusion are formed on the underside of the housing, wherein the protrusion is higher than the flat face and has a first end face. A pivot is located in the insertion hole and has a first end and a second end, and a slide is connected to the second end of the pivot. A spring is located in the insertion hole and applies a first resilient force toward the insertion hole and a second resilient force toward a direction that the slide pivots. The first end of the spring is fixed in the insertion hole and the second end of the spring is connected to the pivot. When the slide is located at a first position, the slide is applied by the first resilient force of the spring and located at the flat face so that the slide is applied by the second resilient force of the spring to cover the installation recess. When the slide is located at a second position, the slide is pivoted to overcome the second resilient force of the spring and has at least one portion thereof not covering the installation recess. When the slide is located at a third position, the slide is pivoted and the pivot moves axially to compress the spring and to overcome the first resilient force of the spring, such that the slide is located above the first end face of the protrusion and continuously pivoted, and at least one portion of the slide does not cover the installation recess.

Preferably, the slide contacts the first end face when the slide is positioned at the second position.

Preferably, the spring has a first leg on the first end thereof, and the insertion hole has a side hole defined in the inside thereof. The first leg is fixed in the side hole to fix the spring to the insertion hole.

Preferably, the spring has a second leg on the second end thereof, and the pivot has a slot defined in the first end thereof. The second leg is engaged with the slot to fix the spring to the pivot.

Preferably, the slot includes a radial hole defined radially in the first end thereof. A pin extends through the radial hole. The second leg is restricted between the inner end of the slot and the pin.

Preferably, the pivot has a stop ring securely mounted to the first end thereof. The stop ring is located between the inner end of the slot and the pin.

Preferably, a sleeve is located in the insertion hole and receives the spring therein to restrict the pin. The sleeve has a top portion formed on the first end thereof which is located opposite to the slide. The second end of the sleeve includes two notches defined in the wall thereof. The notches are located corresponding to the first leg and the side hole.

Preferably, the insertion hole is used to receive one end of a shackle.

Preferably, the insertion hole has an annular flange extending from the inside thereof so as to define a through hole at the center of the annular flange. The through hole communicates with the insertion hole. The pivot has a contact portion extending radially from the second end thereof. The pivot extends through the through hole, and the contact portion contacts the underside of the annular flange. The first end of the spring contacts the top of the annular flange.

Preferably, the protrusion has a second end face. The slide is applied by the second resilient face of the spring to contact the second end face of the protrusion when the slide is located at the first position.

Preferably, the slide includes a wall extending from one side thereof. The wall contacts the outside of the housing when the slide is located at the first position.

Preferably, the spring is a compressible torsion spring.

Preferably, the flat face of the housing has a concavity, and a resilient member, a positioning member and a restriction member are received in the concavity. The restriction member has an opening, and the positioning member has a narrowed engaging portion which extends through the opening. When the slide is located at the first position, the engaging portion is biased by the resilient member and contacts the slide. When the slide is located at the second position, the slide is located away from the engaging portion which protrudes beyond the flat face.

Preferably, the installation recess has a core received therein, and the core has a keyhole which faces the slide. When the slide is located at the second position, the slide does not cover the keyhole. When the slide is located at the third position, the slide does not cover the core.

Preferably, the core is a fixed core or a replaceable core.

The advantages of the present invention include that the spring applies a first resilient force toward the insertion hole and a second resilient force toward a direction that the slide pivots, so that when the slide is not applied by any foreign force, the first resilient force applies to the slide and positions the slide on the flat face. The slide is applied by the second resilient force as well to cover the installation recess to prevent rain, dust and other object from entering the installation recess such that the core is not rusted and the life of use of the lock is prolonged. When unlocking the lock, the user pivots the slide to not allow at least one portion of the slide to cover the keyhole so that the user can use a key to unlock the lock. When the slide is located at the third position, the slide does not cover the core, so that the core is conveniently picked out from the installation recess and replaced.

By the resilient member, the positioning member and the restriction member, when the slide is located at the second position, the slide is removed from the engaging portion, and the engaging portion protrudes beyond the flat face. When the slide is applied by the second resilient force, one side of the slide is restricted by the engaging portion so that the cover cannot be pivoted. This helps the user to conveniently unlock the lock.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
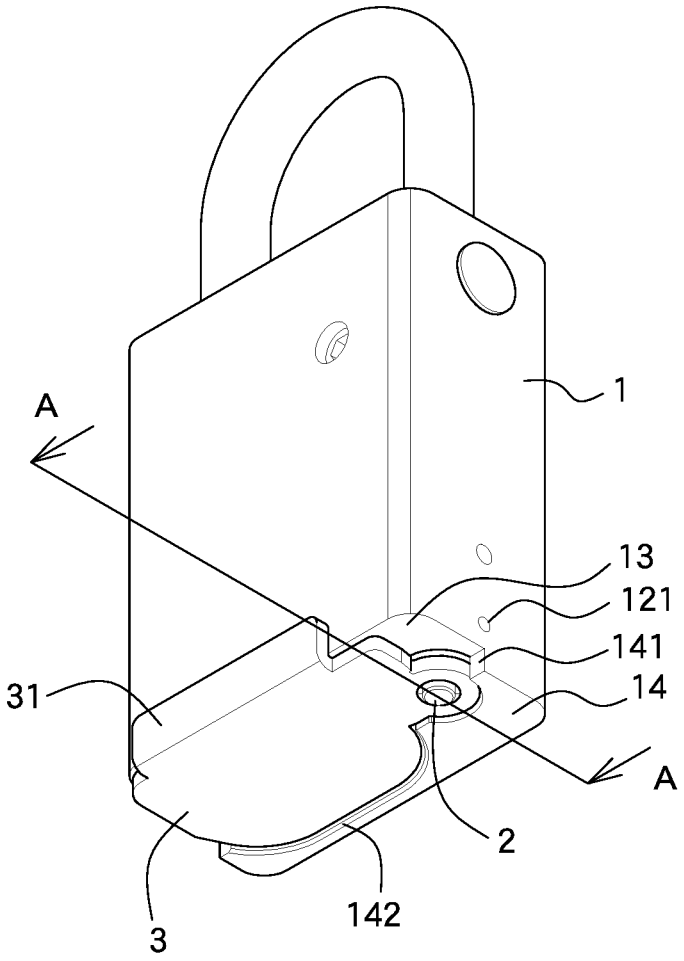
FIG. 1 is a perspective view to show the lock of the present invention.
Figure 2:
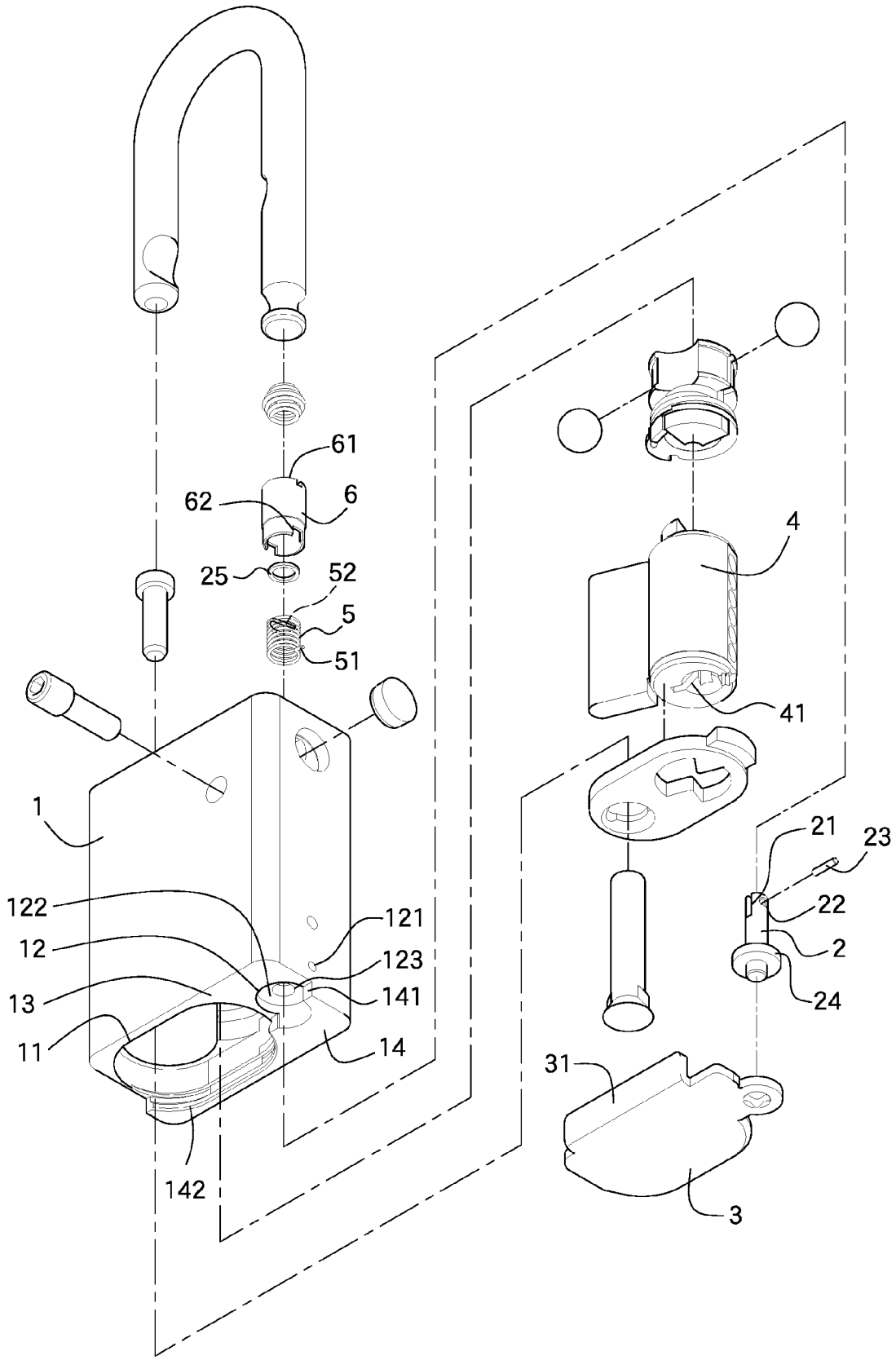
FIG. 2 is an exploded view of the lock of the present invention.

Referring to FIGS. 1 to 6, the lock of the present invention comprises a housing 1 having an installation recess 11 and an insertion hole 12 defined in the underside thereof. A flat face 13 and a protrusion 14 are formed on the underside of the housing 1, wherein the protrusion 14 is higher than the flat face 13 and has a first end face 141.

A pivot 2 is located in the insertion hole 12 and has a first end and a second end. A slide 3 is connected to the second end of the pivot 2. The installation recess 11 has a core 4 received therein, and the core 4 has a keyhole 41 which faces the slide 3. The core 4 is a fixed core or a replaceable core.

A spring 5 is located in the insertion hole 12 and applies a first resilient force toward the insertion hole 12 and a second resilient force toward the direction that the slide 3 pivots. The spring 5 is normally extended to form the first resilient force which tends to retract the spring 5. The spring 5 is normally twisted to form the second resilient force which tends to rewind the spring 5 to its initial status. The spring 5 is a compressible torsion spring to provide the first and second resilient forces.

The first end of the spring 5 is fixed in the insertion hole 12 and the second end of the spring 5 is connected to the pivot 2. In one embodiment, the spring 5 has a first leg 51 on the first end thereof. The insertion hole 12 has a side hole 121 defined in the inside thereof. The first leg 51 is fixed in the side hole 121 to fix the spring 5 to the insertion hole 12. The spring 5 has a second leg 52 on the second end thereof. The pivot 2 has a slot 21 defined in the first end thereof. The second leg 52 is engaged with the slot 21 to fix the spring 5 to the pivot 2.

In one embodiment, in order to secure the second leg 52 in the slot 21, the slot 21 includes a radial hole 22 defined radially in the first end thereof. A pin 23 extends through the radial hole 22. The second leg 52 is restricted between the inner end of the slot 21 and the pin 23.

The insertion hole 12 has an annular flange 122 extending from the inside thereof so as to define a through hole 123 at the center of the annular flange 122. The through hole 123 communicates with the insertion hole 12. The pivot 2 has a contact portion 24 extending radially from the second end thereof. The pivot 2 extends through the through hole 123. The contact portion 24 contacts the underside of the annular flange 122, and the first end of the spring 5 contacts the top of the annular flange 122. By the contact between the spring 5 and the annular flange 122, the first resilient force is maintained linearly. The pivot 2 has a stop ring 25 securely mounted to the first end thereof. The stop ring 25 is a thin ring which contacts the spring 5 by its face instead of a point. The stop ring 25 is located between the inner end of the slot 21 and the pin 23, so that the stop ring 25 is prevented from being disengaged from the pivot 2.

Figure 4:
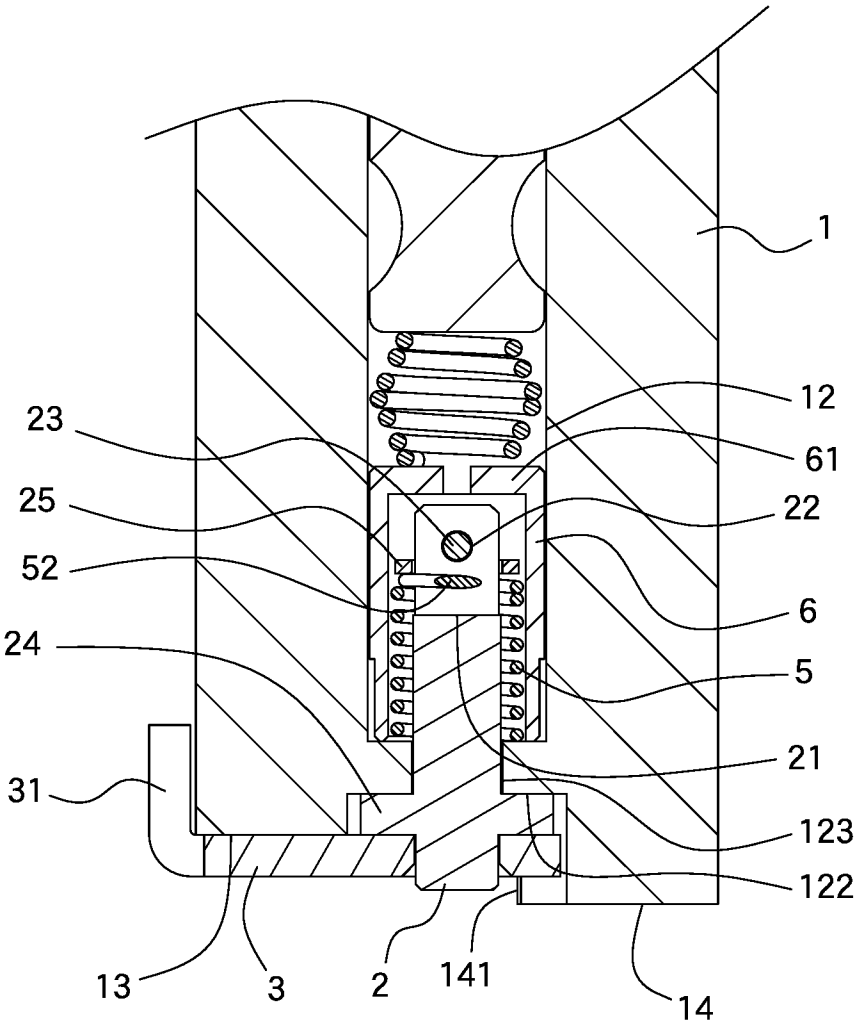
FIG. 4 is a cross sectional view, taken along line A-A in FIG. 1, while the slide is located at the first position.
Figure 6:
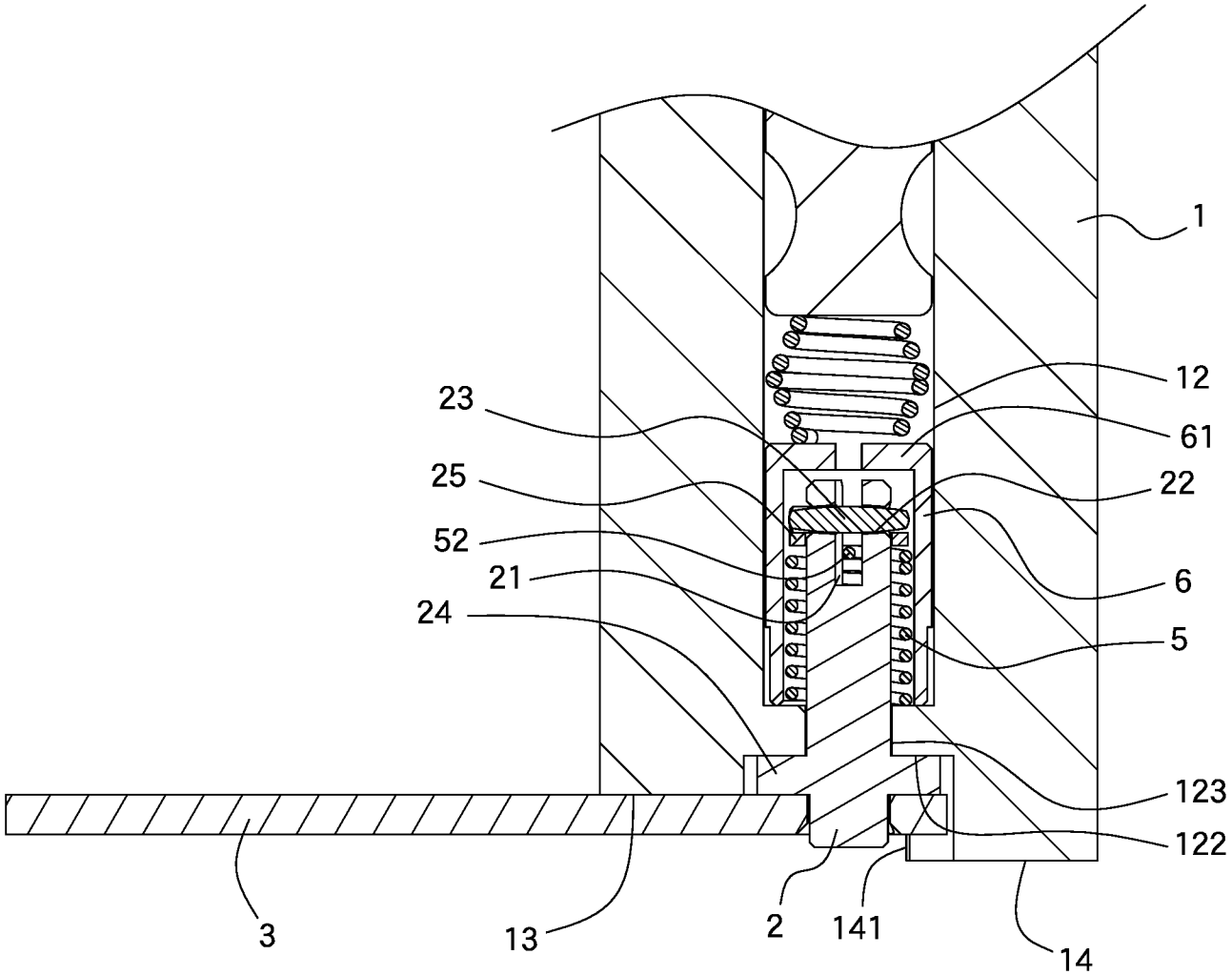
FIG. 6 is a cross sectional view of the lock when the slide is located at the second position.

A sleeve 6 is located in the insertion hole 12 and receives the spring 5 therein to restrict the pin 23. The sleeve 6 has a top portion 61 formed on the first end thereof which is located opposite to the slide 3. As shown in FIG. 6, the sleeve 6 restricts the pin 23 in the radial hole 22, and securely accommodates the pivot 2 and the spring 5 in the sleeve 6. The use of the sleeve 6 also makes the room in the housing 1 be more efficiently used. As shown in FIG. 4, the insertion hole 12 is adapted to receive one end of a shackle. By the top portion 61 of the sleeve 6, the shackle and the spring of the shackle are separated from the pivot 2 and the spring 5, such that when locking or unlocking the lock, the shackle and the spring of the shackle do not interfere operation of the pivot 2 and the spring 5. The second end of the sleeve 6 includes two notches 62 defined in the wall thereof. The notches 62 are located corresponding to the first leg 51 and the side hole 121 so that the first leg 51 extends through one of the notches 62 and inserted into the side hole 121.

Figure 3:
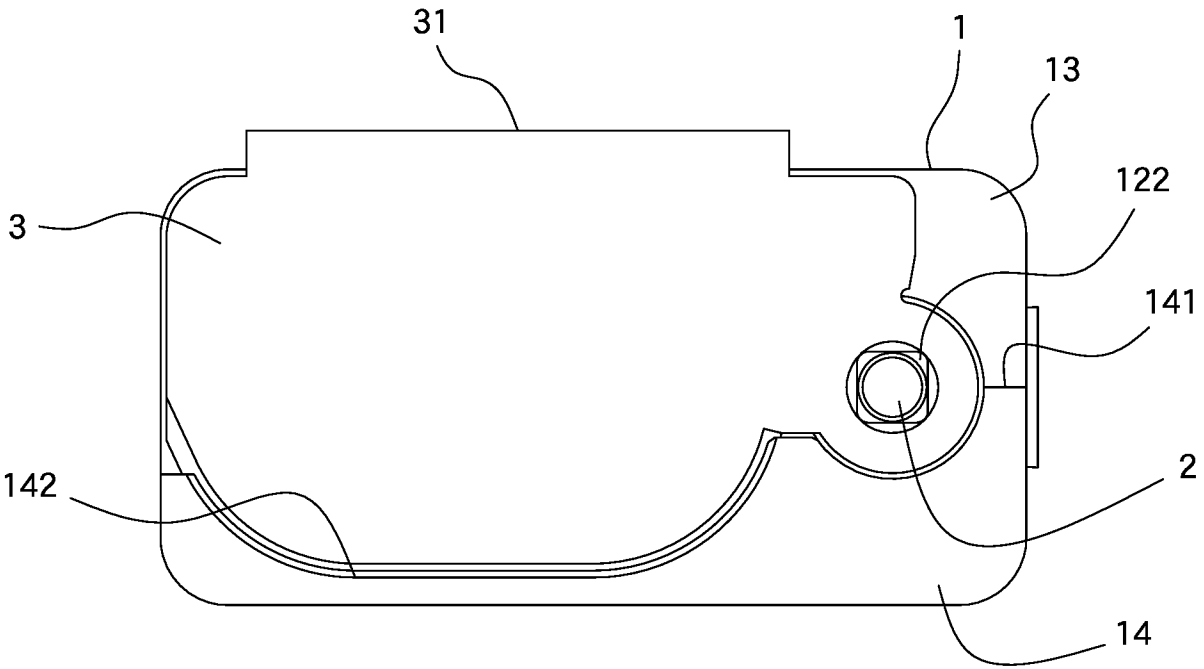
FIG. 3 is a bottom view when the slide is located at the first position.

As shown in FIGS. 3 and 4, when the lock is not in use or under locked status, the slide 3 is positioned at the first position. The slide 3 is not applied by any foreign force, the first resilient force applies to the slide 3 and positions the slide 3 on the flat face 13. The slide 3 is applied by the second resilient force as well to cover the installation recess 11 to prevent rain, dust and other object from entering the installation recess 11 such that the core 4 is not rusted and the life of use of the lock is prolonged. In order to ensure that the slide 3 covers the installation recess 11, in one embodiment, the protrusion 14 has a second end face 142. When the slide is positioned at the first position, one side of the slide 3 is applied by the second resilient face of the spring 5 and contacts the second end face 142 of the protrusion 14 to ensure that the slide 3 covers the installation recess 11. In another embodiment, there is no second end face 142, the slide 3 includes a wall 31 extending from one side thereof. The wall 31 contacts the outside of the housing 1 when the slide 3 is located at the first position. The slide 3 is restricted as well. As shown in the present embodiment, the protrusion 14 has the second end face 142 and the slide 3 has the wall 31.

Figure 5:
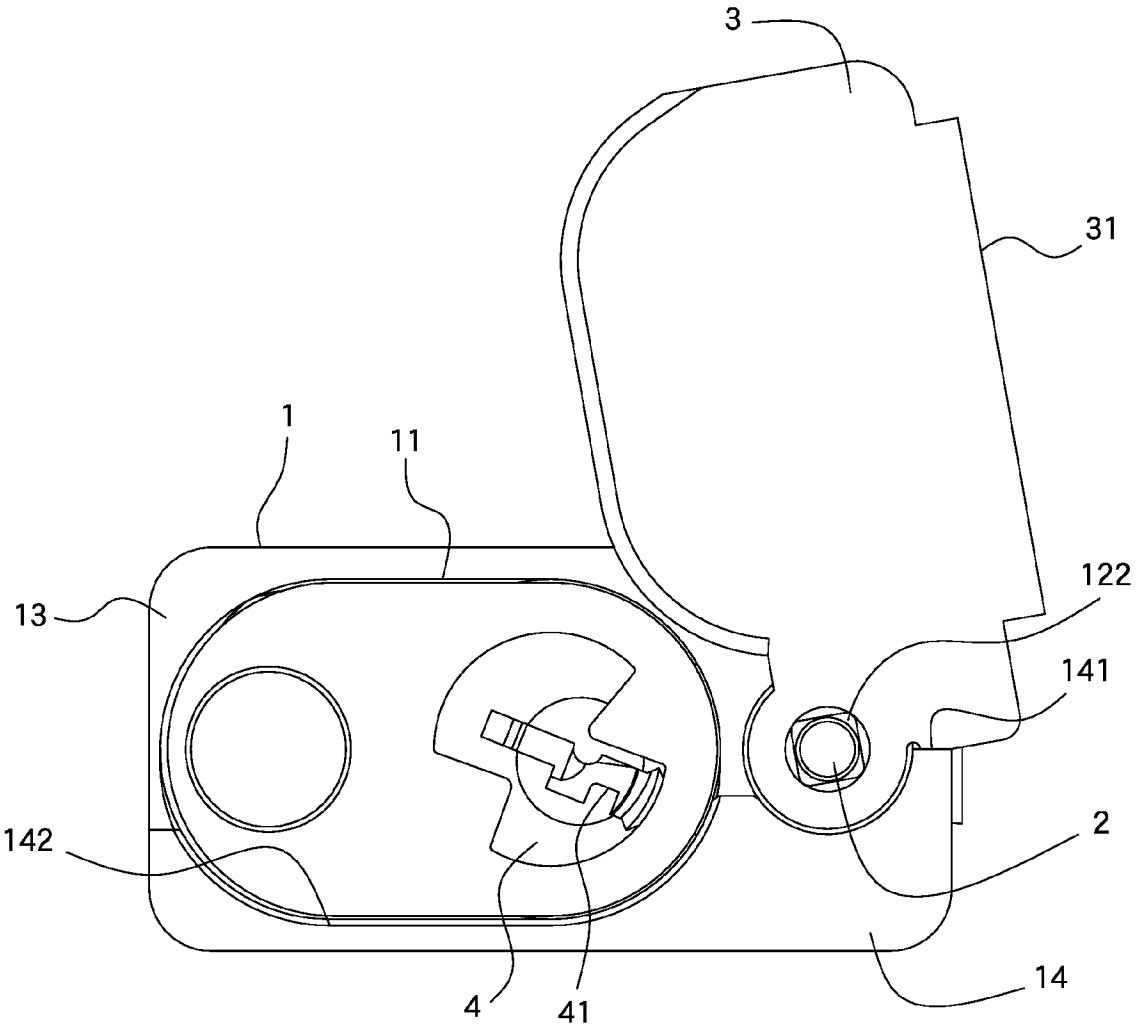
FIG. 5 is a bottom view when the slide is located at the second position.

When the user wants to unlock the lock, the user pivots the slide 3 as shown in FIGS. 5 and 6, the slide 3 overcomes the second resilient force and moves to the second position to make the slide 3 uncover the keyhole 41. The user uses a key to insert into the keyhole 41 to unlock the lock. It is noted that at least one portion of the slide 3 does not cover the installation recess 11. In other words, the slide 3 is not necessarily to move completely from the installation recess 11 of the core 4, only the keyhole 41 is exposed is sufficient for the user to unlock the lock. In one embodiment, the slide 3 is moved completely away from the installation recess 11 of the core 4 for convenience of pick-up or replacement of the core 4. In another embodiment, the first end face 141 is located such that when the slide 3 is positioned at the second position, the slide 3 contacts the first end face 141, so that the user can easily pivot the slide 3 to the second position.

Figure 7:
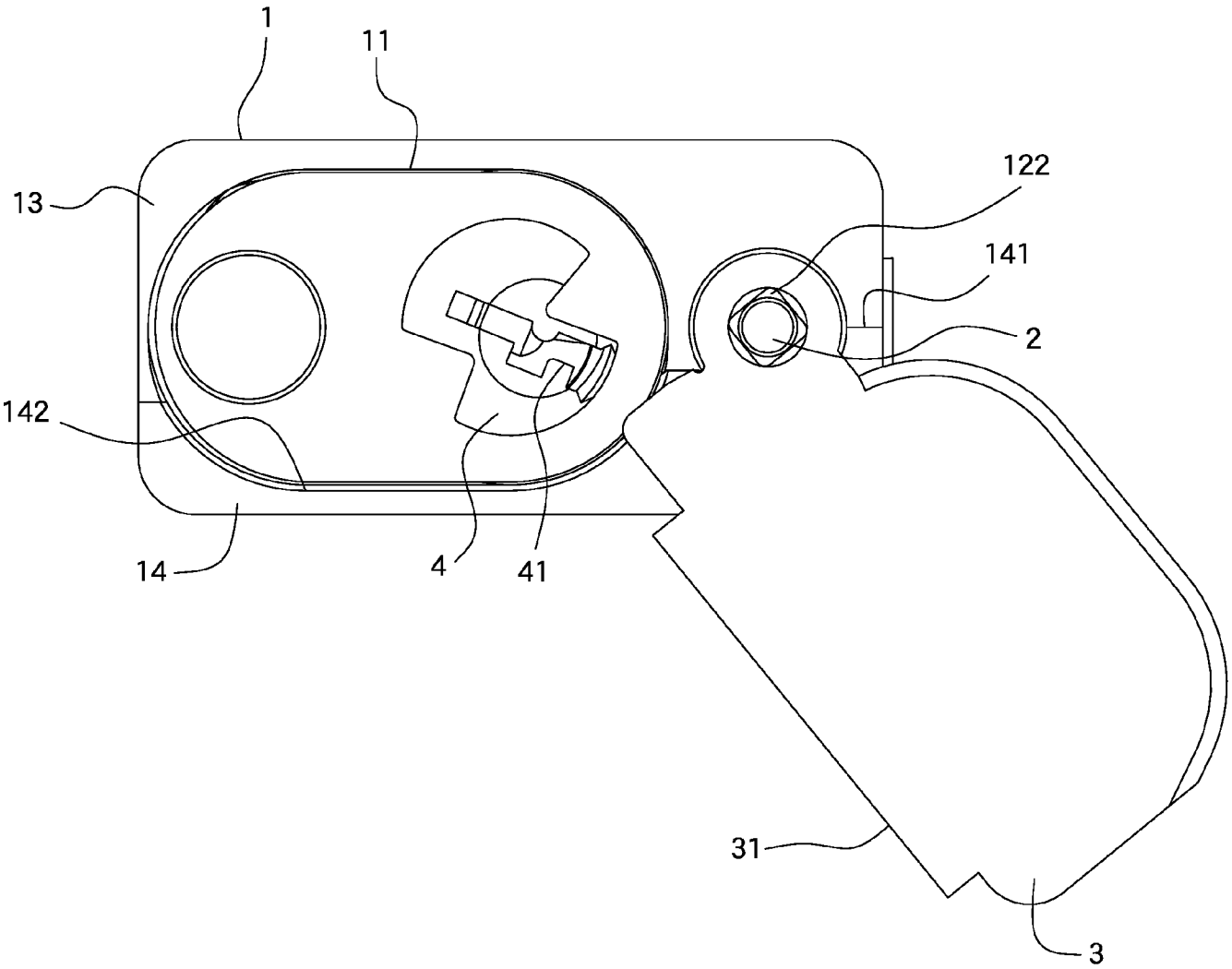
FIG. 7 is a bottom view when the slide is located at the third position.
Figure 8:
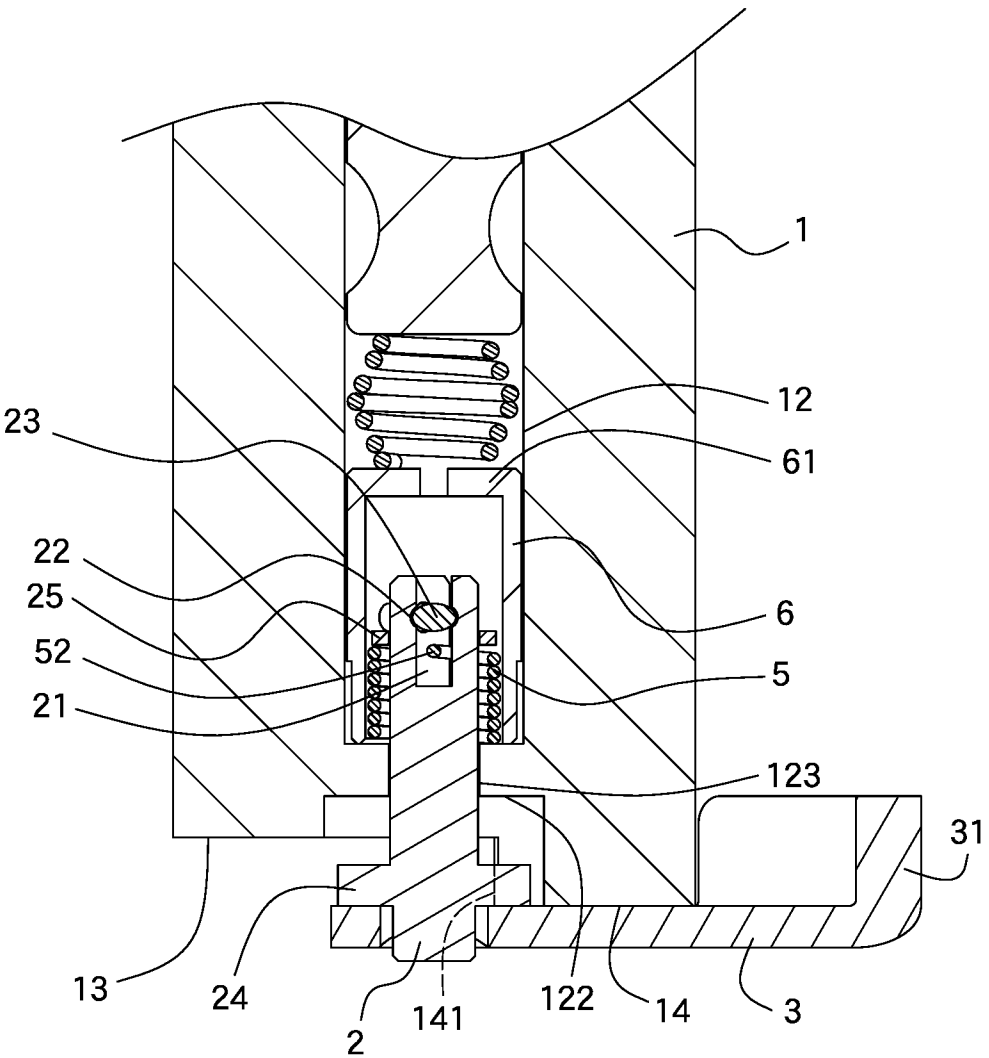
FIG. 8 is a cross sectional view of the lock when the slide is located at the third position.

In order to allow users to pivot the slide 3 to the third position so as to replace the core 4 or unlock the lock, as shown in FIGS. 7 and 8, the user may apply a force to the slide 3, and the pivot 2 moves axially to compress and spring 5 and to overcome the first resilient force of the spring 5. The slide 3 is located above the first end face 141 of the protrusion 14 and can be continuously pivoted. At least one portion of the slide 3 does not cover the installation recess 11. The keyhole 41 is not covered so that the user can unlock the lock by using the key. When the slide 3 is located at the third position, at least one portion of the slide 3 does not cover the installation recess 11, and the core 4 is completely not covered.

It is noted that a preferable embodiment of the present invention is equipped with a replaceable core. When the slide 3 is positioned at the second position, the slide 3 is only required not to cover the keyhole 41, and the slide 3 can partially cover the core 4 to prevent the core 4 from unintentionally picking out the core 4 from the housing 1. When the slide 3 is positioned at the third position, the slide 3 is completely away from the core 4 so that the user can easily replace the core 4.

Figure 9:
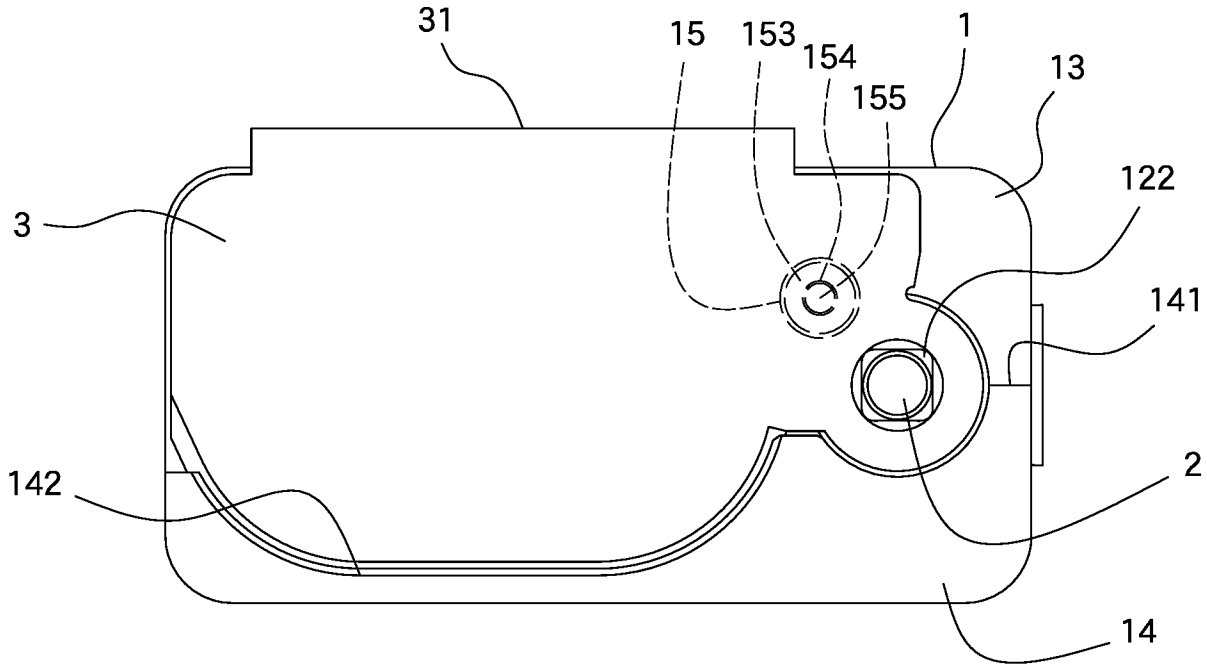
FIG. 9 is a bottom view of the second embodiment of the lock when the slide is located at the first position.
Figure 10:
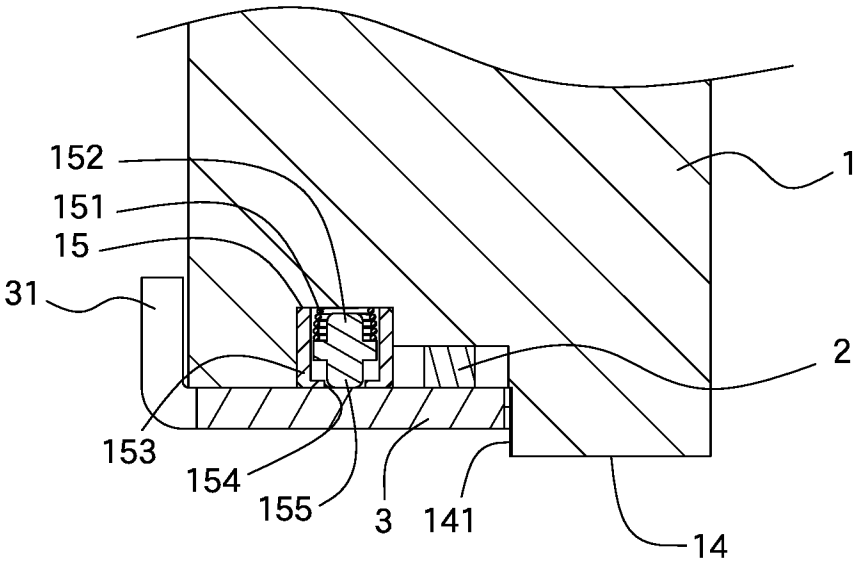
FIG. 10 is a cross sectional view at the concavity of the lock of the second embodiment of the lock when the slide is located at the first position.
Figure 11:
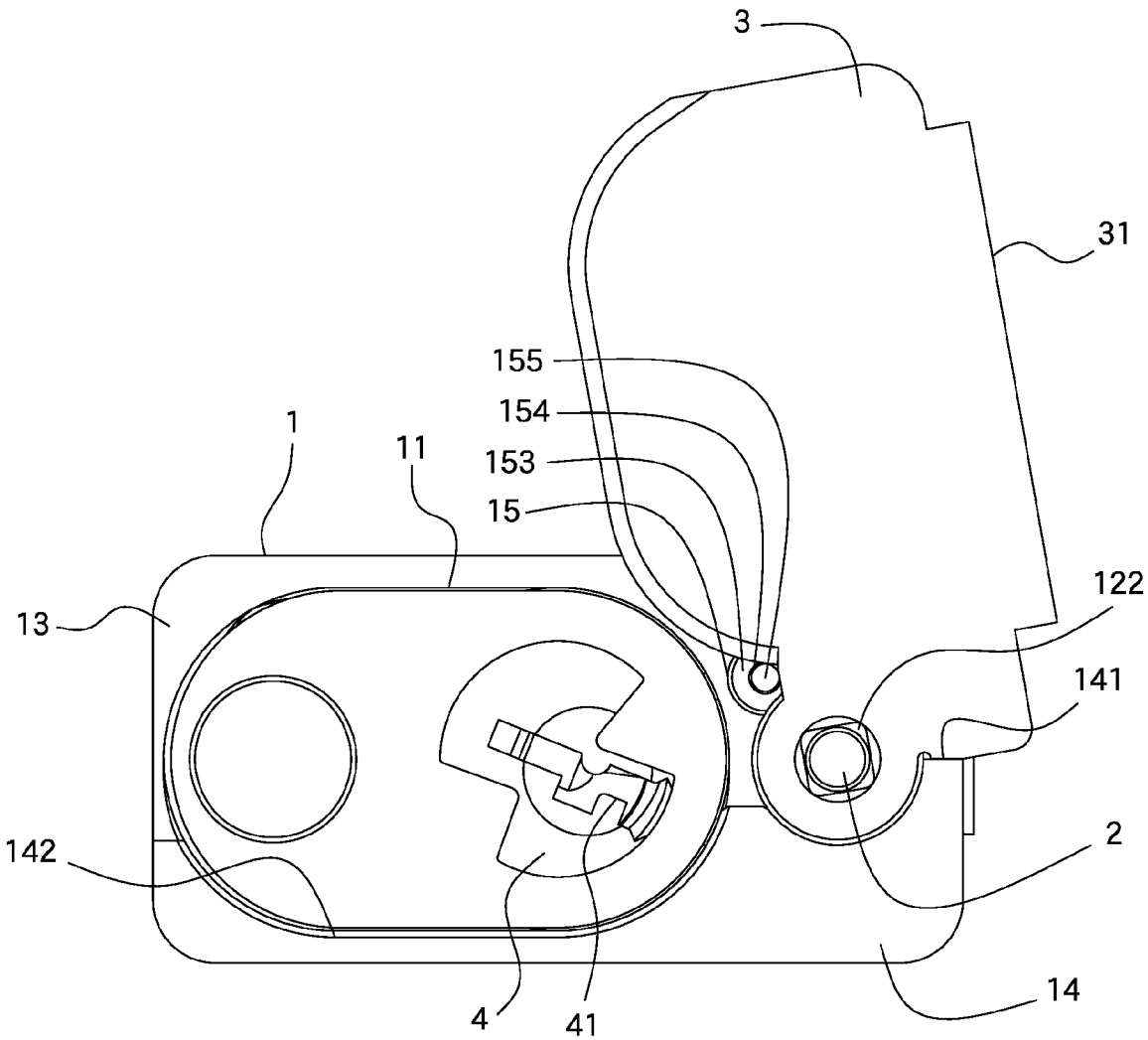
FIG. 11 is a bottom view of the second embodiment of the lock when the slide is located at the second position.
Figure 12:
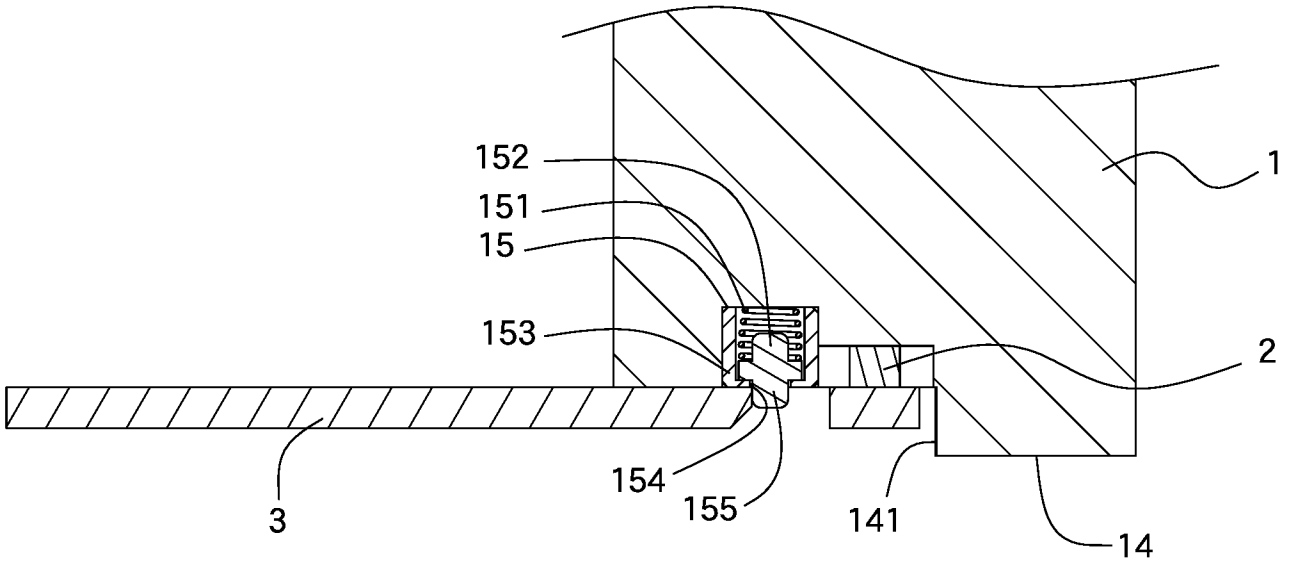
FIG. 12 is a cross sectional view at the concavity of the lock of the second embodiment of the lock when the slide is located at the second position.

As shown in FIGS. 9 to 12, the second embodiment of the present invention is disclosed and the differences from the first embodiment are that the flat face 13 of the housing 1 has a concavity 15. A resilient member 151, a positioning member 152 and a restriction member 153 are received in the concavity 15. The restriction member 153 has an opening 154. The positioning member 152 has a narrowed engaging portion 155 which extends through the opening 154. As shown in FIGS. 9 and 10, when the slide 3 is located at the first position, the engaging portion 155 is biased by the resilient member 151 and contacts the slide 3. As shown in FIGS. 11 and 12, when the slide 3 is located at the second position, the slide 3 is located away from the engaging portion 155 which protrudes beyond the flat face 13. When the user stops to apply a force to the slide 3, and the slide 3 tends to move back to the first position, one side of the slide 3 is stopped by the engaging portion 155, so that the user does not need to continuously apply a force to the slide 3 and can unlock the lock easily and conveniently.

While we have shown and described the embodiment in accordance with the present invention, it should be clear to those skilled in the art that further embodiments may be made without departing from the scope of the present invention.

What is claimed is:

1. A lock comprising:

a housing having an installation recess and an insertion hole defined in an underside thereof, a flat face and a protrusion formed on the underside of the housing, the protrusion being higher than the flat face and having a first end face;

a pivot located in the insertion hole and having a first end and a second end, a slide connected to the second end of the pivot;

a spring located in the insertion hole and applying a first resilient force toward the insertion hole and a second resilient force toward a direction that the slide pivots, a first end of the spring being fixed to an inner wall surface surrounding the insertion hole and a second end of the spring connected to the pivot, and when the slide is located at a first position, the slide is applied by the first resilient force of the spring and located on the flat face, the slide is applied by the second resilient force of the spring to cover the installation recess;

when the slide is located at a second position, the slide is pivoted to overcome the second resilient force of the spring and has at least one portion thereof not covering the installation recess; and when the slide is located at a third position, the slide is pivoted and the pivot moves axially to compress the spring and to overcome the first resilient force of the spring, the slide is located above the first end face of the protrusion and continuously pivotable, and at least one portion of the slide does not cover the installation recess;

wherein the spring has a first leg on the first end thereof, the insertion hole has a side hole defined in an inside thereof, the first leg is fixed in the side hole to fix the spring to the insertion hole;

the spring has a second leg on the second end thereof, the pivot has a slot defined in the first end thereof, the second leg is engaged with the slot to fix the spring to the pivot; and the slot includes a radial hole defined radially in the first end thereof, a pin extends through the radial hole, the second leg is restricted between an inner end of the slot and the pin.

2. The lock as claimed in claim 1, wherein the slide contacts the first end face when the slide is positioned at the second position.

3. The lock as claimed in claim 1, wherein the pivot has a stop ring securely mounted to the first end thereof, the stop ring is located between the inner end of the slot and the pin.

4. The lock as claimed in claim 1, wherein a sleeve is located in the insertion hole and receives the spring therein to maintain the pin within the radial hole of the pivot, the sleeve has a top portion formed on a first end thereof which is located opposite to the slide, a second end of the sleeve includes two notches defined in a wall thereof, the notches are located corresponding to the first leg and the side hole.

5. The lock as claimed in claim 4, wherein the insertion hole is adapted to receive one end of a shackle.

6. The lock as claimed in claim 1, wherein the insertion hole has an annular flange extending from an inside thereof so as to define a through hole at a center of the annular flange, the through hole communicates with the insertion hole, the pivot has a contact portion extending radially from the second end thereof, the pivot extends through the through hole, the contact portion contacts an underside of the annular flange, the first end of the spring contacts a top of the annular flange.

7. The lock as claimed in claim 1, wherein the protrusion has a second end face, the slide is applied by the second resilient force of the spring to contact the second end face of the protrusion when the slide is located at the first position.

8. The lock as claimed in claim 1, wherein the slide includes a wall extending from one side thereof, the wall contacts an outside of the housing when the slide is located at the first position.

9. The lock as claimed in claim 1, wherein the spring is a compressible torsion spring.

10. The lock as claimed in claim 1, wherein the flat face of the housing has a concavity, a resilient member, a positioning member and a restriction member are received in the concavity, the restriction member has an opening, the positioning member has a narrowed engaging portion which extends through the opening, when the slide is located at the first position, the engaging portion is biased by the resilient member and contacts the slide, when the slide is located at the second position, the slide is located away from the engaging portion which protrudes beyond the flat face.

11. The lock as claimed in claim 1, wherein the installation recess has a core received therein, the core has a keyhole which faces the slide, when the slide is located at the second position, the slide does not cover the keyhole, when the slide is located at the third position, the slide does not cover the core.

12. The lock as claimed in claim 11, wherein the core is a fixed core or a replaceable core.

13. A lock comprising:

a housing having an installation recess and an insertion hole defined in an underside thereof, a flat face and a protrusion formed on the underside of the housing, the protrusion being higher than the flat face and having a first end face;

a pivot located in the insertion hole and having a first end and a second end, a slide connected to the second end of the pivot;

a spring located in the insertion hole and applying a first resilient force toward the insertion hole and a second resilient force toward a direction that the slide pivots, a first end of the spring being fixed to an inner wall surface surrounding the insertion hole and a second end of the spring connected to the pivot, and when the slide is located at a first position, the slide is applied by the first resilient force of the spring and located on the flat face, the slide is applied by the second resilient force of the spring to cover the installation recess;

when the slide is located at a second position, the slide is pivoted to overcome the second resilient force of the spring and has at least one portion thereof not covering the installation recess; and when the slide is located at a third position, the slide is pivoted and the pivot moves axially to compress the spring and to overcome the first resilient force of the spring, the slide is located above the first end face of the protrusion and continuously pivotable, and at least one portion of the slide does not cover the installation recess;

wherein the flat face of the housing has a concavity, a resilient member, a positioning member and a restriction member are received in the concavity, the restriction member has an opening, the positioning member has a narrowed engaging portion which extends through the opening, when the slide is located at the first position, the engaging portion is biased by the resilient member and contacts the slide, when the slide is located at the second position, the slide is located away from the engaging portion which protrudes beyond the flat face.

* * * * *